United States Patent [19]

Girard et al.

[11] Patent Number: 4,667,650

[45] Date of Patent: May 26, 1987

[54] MOUNTING BEAM FOR PREPARING WAFERS

[75] Inventors: Richard T. Girard, Coventryville; John R. McLaughlin, Media, both of Pa.

[73] Assignee: PQ Corporation, Valley Forge, Pa.

[21] Appl. No.: 800,189

[22] Filed: Nov. 21, 1985

[51] Int. Cl.[4] ..... B28D 1/04

[52] U.S. Cl. ..... 125/13 R; 125/11 R; 51/73 R

[58] Field of Search ..... 51/73 R; 125/13 R, 15, 125/11 R, 12

[56] References Cited

U.S. PATENT DOCUMENTS 3,615,972 10/1971 Morehouse ..... 156/79
4,420,909 12/1983 Steere ..... 125/13 R

FOREIGN PATENT DOCUMENTS 62743 5/1980 Japan ..... 125/13 R
162014 9/1984 Japan ..... 125/13 R

*Primary Examiner*—Harold D. Whitehead
*Attorney, Agent, or Firm*—Ernest G. Posner; J. Stephen Bobb; Fred C. Philpitt

[57] ABSTRACT

A self-dressing mounting beam for slicing wafers from ingots of various materials, especially semiconductors, is described. The mounting beam is a composite material comprising an organic polymer, particles of abrasive and hollow microspheres. The ingot is mounted on the beam and sliced using an inside diameter saw. The saw penetrates the mounting beam as well as the ingot, so that the self-dressing feature is realized with each pass of the blade.

14 Claims, 3 Drawing Figures

MOUNTING BEAM FOR PREPARING WAFERS

BACKGROUND OF THE INVENTION

This invention relates to the production of waferlike materials that require flat surfaces such as semiconductors. More particularly it involves an improvement in the method of slicing ingots or boules by providing an improved mounting beam for said ingots or boules.

The preparation of semiconductor substrates, such as silicon or gallium arsenide, for the fabrication of semiconductor devices requires a number of precisely controlled chemical and mechanical steps. The substrate material is first prepared in a very pure state by whatever preparation and refining methods are required. This material is then crystallized to provide a very large single crystal in the form of an ingot. These ingots are turned on a lathe to roundness, flattened on one side and then sawed or sliced into wafers that are lapped and polished to provide a flat surface for the production of sophisticated electronic components.

Slicing the ingots into wafers is a very important step in the process, since the wafers must be of uniform thickness, have a flat profile and be free of stress produced by slicing. One of the factors that is required to achieve these requirements is that the ingot must be held very securely during the slicing operation. The method currently used involves bonding the ingot to a cutting or mounting beam, usually graphite, with an epoxy adhesive. The graphite cutting beam is coated with the adhesive, and the silicon ingot is placed on the beam. The epoxy is then allowed to cure before a diamond saw is used to slice the ingot into wafers. The wafers are removed from the cutting beam by mechanically and/or chemically breaking the epoxy adhesive bond.

The inside diameter saw is impregnated with diamond and/or other abrasives. In addition to sawing the semi-conductor ingot and epoxy adhesive, the saw penetrates the mounting beam as well. In contacting these various materials the saw blade acquires various deposits which if allowed to accumulate affect blade life, product quality, kerf loss and slicing speed. At present these adverse effects are ameliorated by use of a dressing stick applied to the saw blade by a human operator.

Automated mechanical dressing tools have been suggested, but have not found acceptance. A. D. Morrissey of The Jet Propulsion Laboratory has suggested that patches of blade dressing material be inserted into the mounting beam. See NASA Tech Brief Vol. 8, No. 31 Item #134.

SUMMARY OF THE INVENTION

We have found a better method of providing clean, long-lived sawing of semiconductor materials that requires less or no operator effort and that results in better quality product, by use of a self-dressing, easily cut mounting beam. The mounting beam is fabricated using a composite material comprising a polymer with suitable structural properties, an abrasive capable of dressing the saw blade and microspheres which provide additional dressing value and ease in sawing. The semiconductor ingot is mounted on the composite cutting or mounting beam in any convenient manner; usually an adhesive material that may contain hollow microspheres is used. The inside diameter saw then slices or saws through said ingot and the adhesive and into the mounting beam. The abrasive and microspheres contained in the beam provide dressing action to the saw. The depth to which the saw penetrates can be varied to provide the degree of dressing that the saw requires. This self dressing feature of our beams allows more continuous operation, eliminates operator error and inconsistencies, improves product quality, and lengthens blade life among other advantages, when compared with the prior-art graphite or carbon beams.

DESCRIPTION OF THE DRAWINGS

FIG. 1 illustrates the beam of our construction, showing the mounting beam 1 which is an organic polymer, said mounting beam containing hollow microspheres 11 and particulate abrasives 12 while supporting the semiconductor ingot 2.

FIG. 2*a* shows the ingot mounted on the beam 1 that contains hollow microspheres 11 and abrasive particles 12. The diamond saw is 3.

FIG. 2*b* shows the ingot 2 and mounting beam 1 after the diamond saw 3 has made three cuts to produce the wafers 4 which are still attached to the mounting beam 1. The saw 3 also slices into the beam 1 causing the cuts 5 therein.

INVENTION DETAIL

Figure 1:
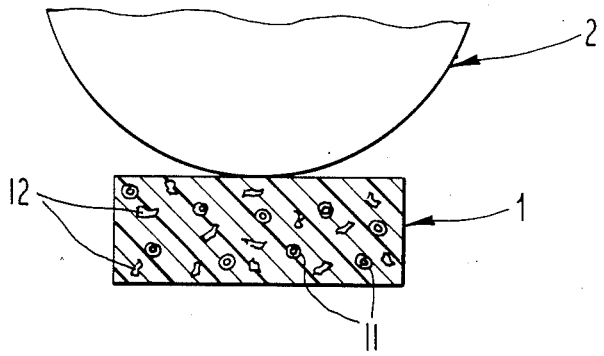
FIG. 1 is a sectional view of the mounting beam.
Figure 2B:
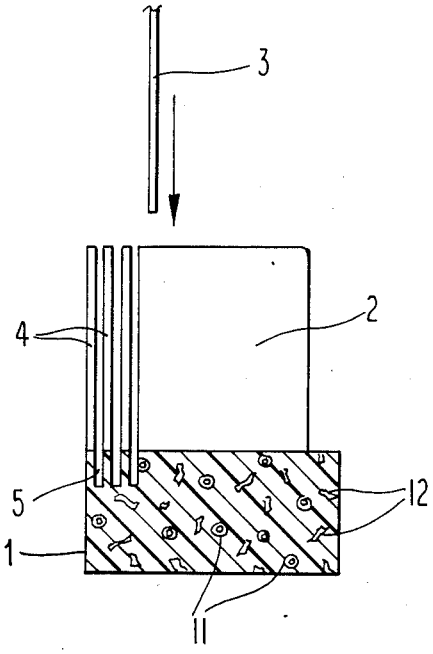
FIGS. 2*a* and 2*b* illustrate the process of slicing the semiconductor ingot and the mounting beam.
Figure 2A:
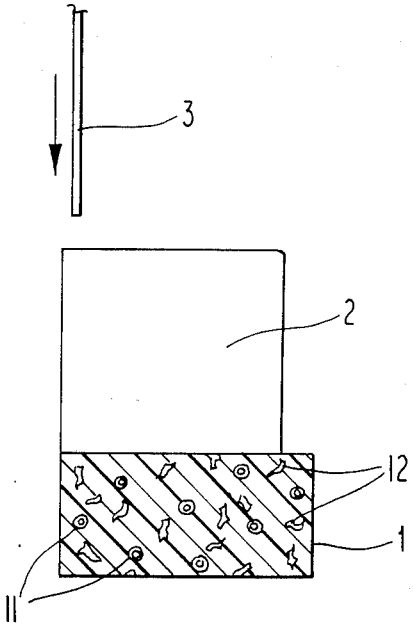

The composite, self-dressing mounting beams of our invention can be cast, pressure molded or extruded depending upon the composition. The polymer or resin used must have sufficient physical strength to resist deformation on handling and in use and be able to accommodate the abrasives and microspheres which complete the composition. Usually thermosetting resins are used. Among numerous organic resins are polyesters, urethanes and epoxies.

The mounting beam also includes a particulate material which serves to dress the diamond saw blade. Materials usually indicated as abrasives and/or polishing agents of 5 to 50 micrometers average particle size are useful. Examples include fused aluminum oxide, zirconia, zirconia alumina, tungsten carbide, cerium oxide and fused aluminum oxide containing titania.

The hollow microspheres can be of any suitable material. Fused glass microspheres such as those described in U.S. Pat. Nos. 3,365,315 and 3,838,998 or silicate-based microspheres described in U.S. Pat. Nos. 2,797,201; 2,978,340; 3,030,215; 3,699,050; 4,059,423 and 4,063,916 are very useful. Hollow microspheres of organic polymer systems are also useful; such materials are described in U.S. Pat. Nos. 2,978,340 and 3,615,972. Hollow microspheres of various materials including glass and metals can be prepared by the methods disclosed in U.S. Pat. Nos. 4,279,632 and 4,344,787, and these materials are also useful. These 11 patents are hereby incorporated by reference as describing materials that are useful in my invention. Hollow microspheres that are of interest are those with shells that are composed of alkali metal silicate and a "polysalt." These materials are described in U.S. Pat. No. 3,796,777, hereby incorporated by reference.

The size of the microspheres can vary widely, but the diameter should not be such that substantial weakening of the polymer bond is realized. In general, microspheres with average diameters of 1 to 500 micrometers appear to be useful.

The composition of our mounting beam can vary widely, but the following broad and preferred ranges are useful:

| Component | Operative Range (pbv) | Preferred Range (pbv) |
|---|---|---|
| Resin (Including catalyst, promotives, etc.) | 15–50 | 20–45 |
| Abrasive particles | 15–45 | 20–35 |
| Microspheres | 20–65 | 25–45 |

The semiconductor ingot can be of any appropriate material. Examples include silicon, doped silicon, germanium or gallium arsenide. The ingot is secured to the beam using any convenient adhesive. We prefer an epoxy adhesive that contains up to about 50% microspheres by volume. Said microspheres can be the same as or different from those used in the mounting beam. The adhesive is allowed to set and/or cure. The bonded structure may be heated to accelerate the cure. The ingot is now sliced into wafers using an inside diameter diamond saw blade. The saw usually does not cut completely through the mounting beam, but should penetrate sufficiently to realize the self-dressing nature of the imbedded abrasive(s) and hollow microspheres.

Our invention has been described in terms of slicing semiconductor materials; however, the process and our improved mounting beam can be used to slice or saw nearly any material that can be machined and requires fabrication of flat surfaces. Examples of such materials include beryllia, fused silica, fused quartz or glass.

EXAMPLES

The following examples illustrate certain embodiments of our invention. These examples are not provided to establish the scope of the invention, which is described in the disclosure and recited in the claims. The proportions are in parts by volume (pbv) or percent by volume (% v/v) unless otherwise indicated.

Example 1

A series of mounting beams were prepared and used to mount ingots of silicon semiconductor material. The hollow microspheres used in preparing these beams had shells consisting of sodium silicate and a "polysalt" as described in U.S. Pat. No. 3,796,777. The resin used was an epoxy manufactured by Shell Chemical Co. The abrasive material was alumina with an average particle size of 20 microns. The ingredients were combined in various combinations and the beams cast. After the beams had cured they were used as supports for slicing silicon wafers from ingots. The results are summarized in the following table.

| Component | Formulation (pbv) I | II | III |
|---|---|---|---|
| Resin including promoter | 36 | 32 | 31 |
| Microspheres | 43 | 36 | 25 |
| Alumina | 21 | 31 | 45 |
| Observation | Excellent No blade dressing required. | Good | Poor Blade gummed up. |

These results indicate that the proper combination of microspheres and abrasive particles provides excellent selfdressing character to the composite mounting beam.

Example 2

A second mounting beam of formulation I of example 1 was prepared with a somewhat different microsphere. The mounting beam also had the desired self dressing quality.

We claim:

1. A mounting beam for semiconductor ingots that dresses the cutting saw during slicing comprising: 15 to 50 parts by volume (pbv) of an organic resin; 15 to 45 pbv of 5 to 50 micrometer particles of an abrasive and 20 to 65 pbv of hollow microspheres.

2. The mounting beam of claim 1 wherein the organic resin is a thermosetting resin, and the abrasive is fused aluminum oxide, zirconia, zirconia alumina, tungsten carbide, cerium oxide, fused aluminum oxide containing titania or mixtures thereof.

3. The mounting beam of claim 1 wherein the resin is an epoxy or polyester and the hollow microspheres have shells composed of an alkali metal silicate and a polysalt, sodium borosilicate glass, sodium alumina silicate glass, soda lime glass, organic polymer or mixtures thereof.

4. The mounting beam of claim 2 wherein the resin is an epoxy or polyester and the hollow microspheres have shells composed of an alkali metal silicate and a polysalt, sodium borosilicate glass, sodium alumina silicate glass, soda lime glass, organic polymer or mixtures thereof.

5. A mounting beam for semiconductor ingots that dresses the cutting saw during slicing comprising: 20 to 45 parts by volume (pbv) of an organic resin; 20 to 35 pbv of 5 to 50 micrometer particles of an abrasive and 20 to 45 pbv of hollow microspheres.

6. The mounting beam of claim 5 wherein the organic resin is a thermosetting resin, and the abrasive is fused aluminum oxide, zirconia, zirconia alumina, tungsten carbide, cerium oxide, fused aluminum oxide containing titania or mixtures thereof.

7. The mounting beam of claim 5 wherein the hollow microspheres have shells composed of an alkali metal silicate and a polysalt, sodium borosilicate glass, sodium alumina silicate glass, soda lime glass, organic polymer or mixtures thereof.

8. The mounting beam of claim 6 wherein the resin is an epoxy or a polyester, the hollow microspheres have shells composed of an alkali metal silicate and a polysalt, sodium borosilicate glass, sodium alumina silicate glass, soda lime glass, organic polymer or mixtures thereof.

9. The process of slicing a semiconductor ingot comprising the steps of:

a. mounting an ingot of semiconductor material on a beam comprising 15 to 50 pbv of a thermosetting resin; 15 to 45 pbv of 5 to 50 micrometer particles of an abrasive and 20 to 65 pbv of hollow microspheres;

b. cutting said ingot with an inside diameter diamond saw to provide wafers;

c. penetrating the mounting beam with said saw sufficiently to provide the desired dressing action.

10. The process of claim 9 wherein the semiconductor is silicon, doped silicon, germanium or gallium arsenide; the mounting beam resin is an epoxy or polyester, and the mounting beam abrasive is fused aluminum oxide, zirconia, zirconia alumina, tungsten carbide, cerium oxide, fused aluminum oxide containing titania or mixtures thereof.

11. The process of claim 9 wherein the microspheres in the mounting beam have shells composed of an alkali metal silicate and a polysalt, sodium borosilicate glass, sodium alumina silicate glass, soda lime glass, organic polymer or mixtures thereof.

12. The process of claim 10 wherein the microspheres in the mounting beam have shells composed of an alkali metal silicate and a polysalt, sodium borosilicate glass, sodium alumina silicate glass, soda lime glass, organic polymer or mixtures thereof.

13. The process of slicing an ingot or boule of beryllia, fused silica, fused quartz or glass comprising the steps of:

a. mounting said ingot or boule on a beam comprising 15 to 50 pbv of an organic resin; 15 to 45 pbv of 5 to 50 micrometer particles of an abrasive and 20 to 65 pbv of hollow microspheres;

b. cutting said ingot with an inside diameter diamond saw to provide wafers;

c. penetrating the mounting beam with said saw sufficiently to provide the desired dressing action.

14. The process of claim 13 wherein the microspheres in the mounting beam have shells composed of an alkali metal silicate and a polysalt, sodium borosilicate glass, sodium alumina silicate glass, soda lime glass, organic polymer or mixtures thereof.

* * * * *